US005542622A

United States Patent [19]

Biagiotti

[11] Patent Number: 5,542,622

[45] Date of Patent: Aug. 6, 1996

[54] METHOD AND MACHINE FOR PRODUCING LOGS OF WEB MATERIAL AND TEARING THE WEB UPON COMPLETION OF THE WINDING OF EACH LOG

[75] Inventor: Guglielmo Biagiotti, Capannori, Italy

[73] Assignee: Fabio Perini S.p.A., Lucca, Italy

[21] Appl. No.: 193,949

[22] Filed: Feb. 9, 1994

[30] Foreign Application Priority Data

Feb. 15, 1993 [IT] Italy ..... FI93A0023

[51] Int. Cl.[6] ..... B65H 35/10

[52] U.S. Cl. ..... 242/521

[58] Field of Search ..... 242/521, 541.2, 242/541.6, 542.2, 542.1, 535.1

[56] References Cited

U.S. PATENT DOCUMENTS

| | | | |
|---|---|---|---|
| 2,573,188 | 10/1951 | Dyken | 242/541.6 X |
| 2,775,410 | 12/1956 | Schwartz et al. | 242/542.2 X |
| 3,791,602 | 2/1974 | Isakson | 242/521 |
| 4,327,877 | 5/1982 | Perini | 242/521 |
| 4,408,727 | 10/1983 | Dropczynski | 242/521 |
| 4,487,377 | 12/1984 | Perini | 242/521 |
| 4,919,351 | 4/1990 | McNeil | 242/521 |

*Primary Examiner*—Daniel P. Stodola
*Assistant Examiner*—Emmanuel M. Marcelo
*Attorney, Agent, or Firm*—Francis J. Bouda

[57] ABSTRACT

A surface rewinding machine for the formation of logs of web material has a winding roller (1) onto which the web material (N) is fed. The winding roller has a surface portion (1A), extending substantially parallel to the roller axis and having a coefficient of friction lower than that of the adjoining surface. The web is pressed at preset moments by a pusher (3) against that portion of the surface of the winding roller having low coefficient of friction so as to tear the web material.

14 Claims, 8 Drawing Sheets

METHOD AND MACHINE FOR PRODUCING LOGS OF WEB MATERIAL AND TEARING THE WEB UPON COMPLETION OF THE WINDING OF EACH LOG

SUMMARY OF THE INVENTION

The invention refers to a surface rewinding machine for the formation of logs of web material, such as rolls or logs of paper for the production of toilet paper, all-purpose wipers and the like, of the type comprising at least a winding roller onto which the web material is fed.

The invention further refers to a method for the production of logs of wound web material, wherein said web material is fed around at least a winding roller and wound up to form a log and wherein the web material is severed after the log is completed with a pre-determined quantity of web material. After the severance of the web material, winding of a new log is started, all without substantial changes in the web material-feeding speed.

The invention refers in particular to a new apparatus and a new method to carry out the severance or tearing of the web material at the end of the winding of each log.

In practice, the rewinder according to the invention is characterized in that the winding roller has a surface portion which extends substantially parallel to the axis of the roller and has a coefficient of friction much lower than that of the adjoining upstream surface of the roller (with respect to the web feeding direction). Means are provided to press the web at pre-set moments against that portion of the winding roller surface having low coefficient of friction. By thus pressing the portion of the web material, which is in contact with the winding roller where the surface has low coefficient of friction, the web can easily slide and be stretched beyond its maximum tensile strength, thereby causing said web material to tear at a pre-determined location.

DETAILED DESCRIPTION

The invention will be better understood by reference being made to the following description and the attached drawing, which show practical, not limiting, examples of the invention. In the drawing:

FIG. 1 shows diagrammatically the rewinder according to the invention in a first embodiment thereof.

FIGS. 2, 2A, 3, and 4 show the rewinder of FIG. 1 in successive steps of the winding cycle, FIG. 2A being an enlarged view of a detail of FIG. 2.

Figure 1:
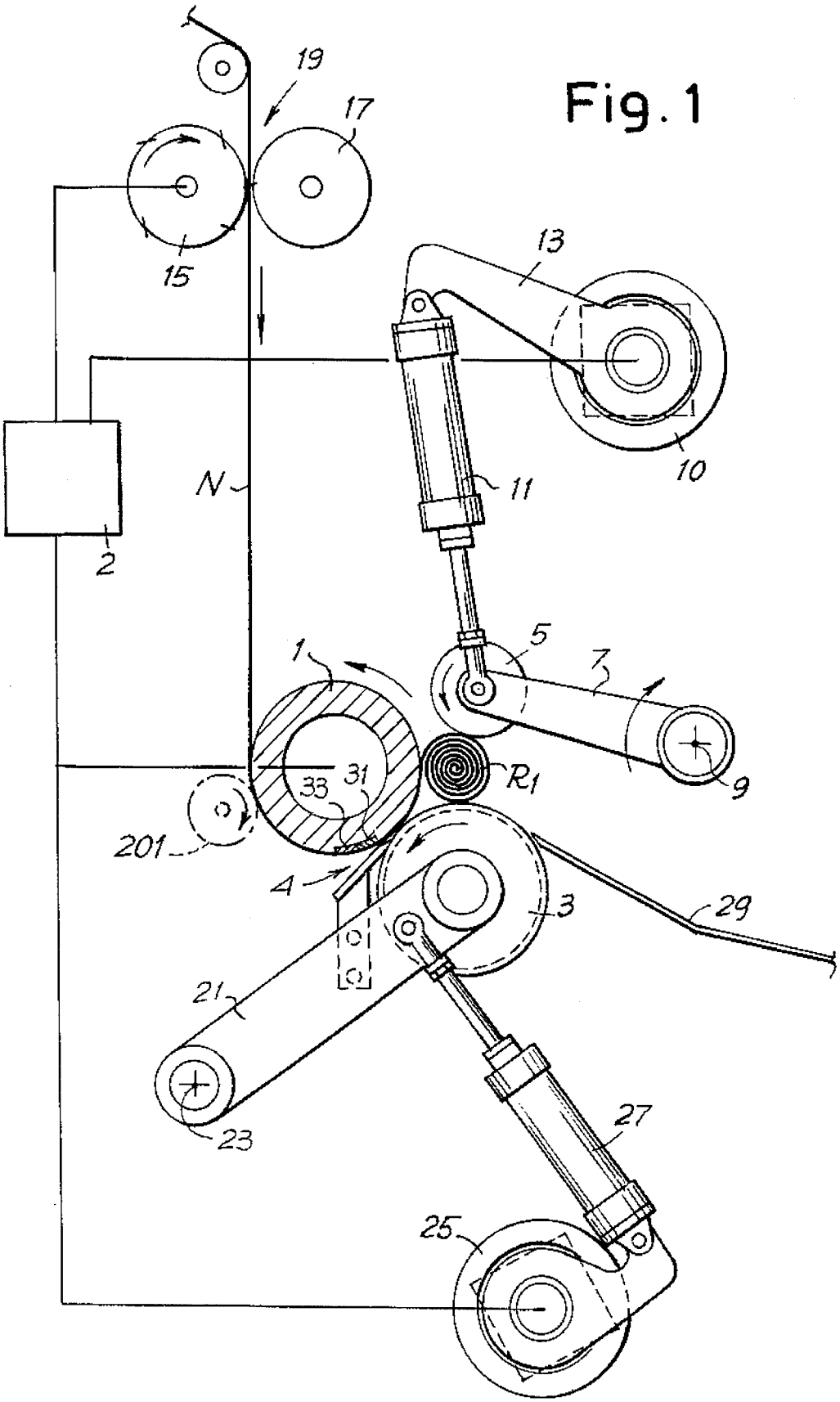

Referring first to FIGS. 1 to 4, a first embodiment of the rewinder according to the invention is provided with a first winding roller 1 and a second winding roller 3, which define a nip through which the web material N to be wound to form a log R passes. FIG. 1 shows the final stage of the winding of log R1, which is carried out within the winding space defined by the two winder rollers 1 and 3, and by a third diameter-control roller 5 supported by an arm 7 pivoted at 9 and driven into an oscillating motion by an actuator 10 in order to follow and control the increase of the diameter of log R. Numeral 11 indicates a pneumatic piston which connects the roller 5 to an arm 13 driven by actuator 10.

Numerals 15 and 17 denote two perforating cylinders of a perforator, generally designated 19, well-known in the art and not illustrated in greater detail. The perforator 19 creates a plurality of perforation lines at regular intervals along the width of the web material N before the latter is fed to the winding region.

In the illustrated example, the three rollers 1, 3, and 5 rotate in the same counterclockwise direction.

The second winding roller 3 is supported by an arm 21 pivoted at 23 to the machine frame. An actuator 25 is connected to the arm 21 through a resilient element 27 made up, for example, of a pneumatic piston similar to piston 11. The actuator 25 causes an oscillating motion of the arm 21 which brings the second winding roller 3 close to winding roller 1 in order to pinch the web material between the two rollers 1, 3. This causes the web to tear and start the winding of a new log, according to the procedure described below. Alternatively, the roller 3 may be stationary and the roller 1 pivotally mounted to provide the relative movement between rollers 1 and 3.

Numeral 2 schematically indicates a central control unit which controls and synchronizes the movements of the various machine members, including the motion of rollers 1, 3, 5 and perforator 19. In particular, it allows the position of the perforation lines created by perforator 19 to be synchronized with the movement of rollers 1 and 3.

Figure 2A:
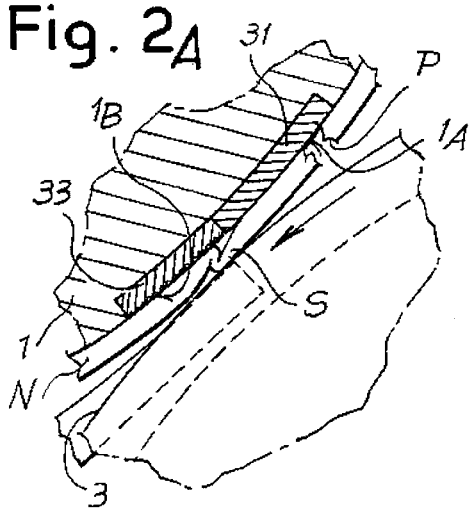
Figure 2:
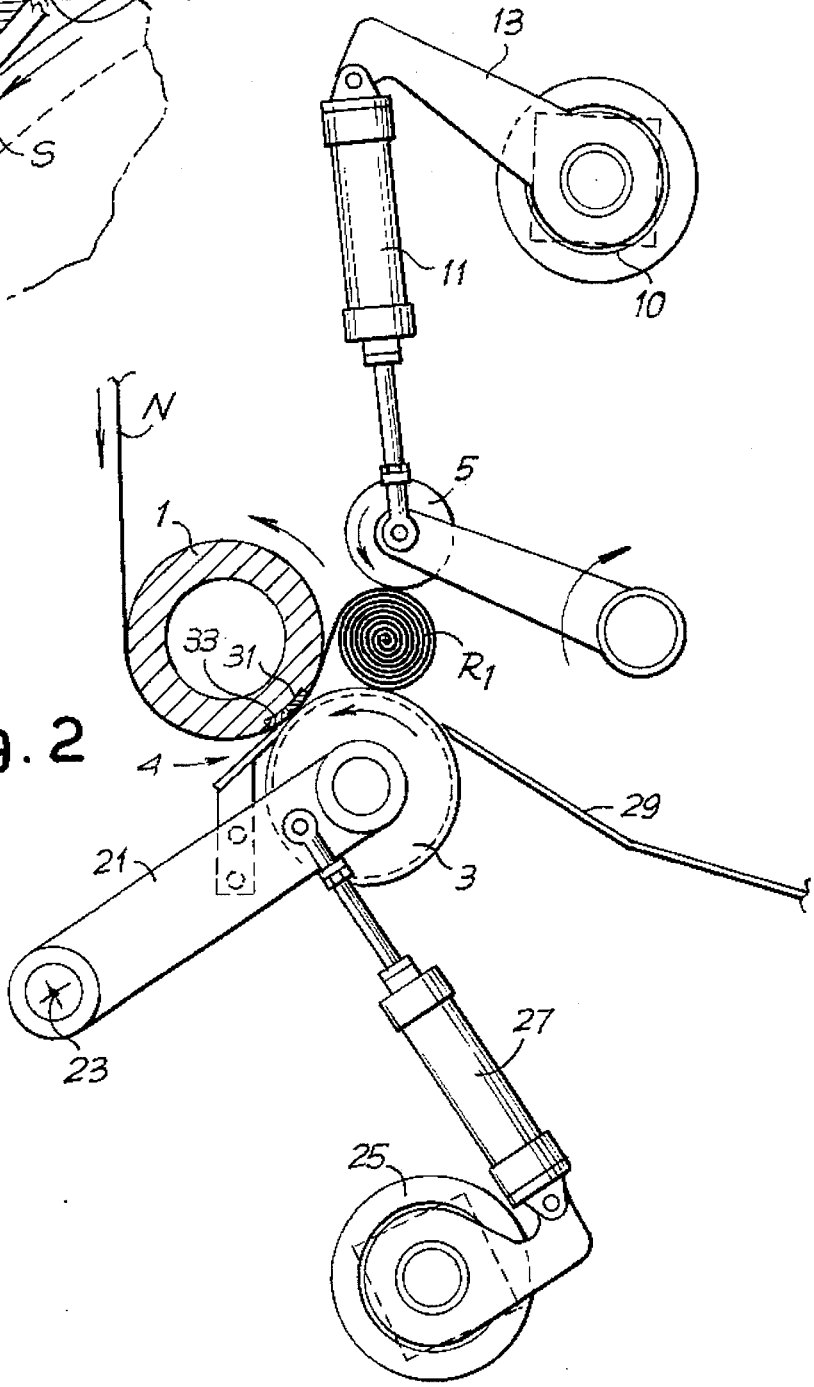

FIG. 2 shows the moment in which the second winding roller 3 is moved close to the first winding roller 1, with consequent pinching of the web material N. At the point of contact, the outer surfaces of rollers 1 and 3 are moving in opposite directions. This causes the formation of a tight loop S in the web material N, with the portion pinched between rollers 1 and 3 tending to increase in speed in an upstream direction, i.e., opposite to that of the portion 0f web material downstream thereof, which is located between the pinching point and the finished log R1. This difference in speed between sections of web material (in some cases increased by the acceleration of roller 5 operated to unload the log R1 from the winding region onto an unloading chute 29) causes the web material N to tear.

Tearing is accomplished quickly and at a precise location in the following manner. The movement toward each other of rollers 1 and 3 is synchronized with the operation of the perforator 19 so that the moment the rollers 1 and 3 pinch the web material between them, a perforation line will be located immediately downstream (with respect to the movement of web material N) of the point of pinching.

On the first winder roller 1 a portion 1A having a low coefficient of friction is formed, for example, by an insert 31 of polished steel or similar material (see in particular FIG. 2A). The surface 1A extends axially along the surface of the roller 1, preferably the full length of roller 1.

The movements of rollers 1 and 3 and of the perforator are so synchronized that the moment the web material N is pinched between the rollers 1 and 3, a perforation line will be located on the surface 1A (or slightly downstream thereof). The pinching of the web between the rollers 1 and 3 begins at surface 1A, and terminates at a portion of surface 1B which is adjacent surface 1A (and possibly slightly upstream thereof, with respect to the direction of movement of the web material N). The surface portion 1B has a higher coefficient of friction than that of surface 1A, said portion 1B being formed, for example, by means of an abrasive cloth or "grip" (commonly used for coating the winding rollers of the surface rewinding machines) or through a suitable surface treatment. The winding of material to form a log begins on said portion 1B.

The surface 1B may be arranged close to the surface 1A or at a short distance therefrom.

The surface 1B may extend over the whole cylindrical development of roller 1, save for the surface strip 1A. In this case, the surface of roller 1 will have two regions of different surface characteristics. Vice versa, as shown in FIG. 2A, the surface 1B may be formed, similar to surface 1A, with an insert 33 housed in a suitable recess of the roller 1. In this case, the surface 1B may have a coefficient of friction higher than that of the remaining cylindrical surface of roller 1. The latter, in any case, will be provided with a coefficient of friction which is higher than that of the smooth surface portion 1A.

The moment at which the rollers 1 and 3 pinch the web material N, the pinched portion of the web slides temporarily backwards on the surface portion 1A. The slide causes a stretching of the web material beyond the maximum tensile strength thereof, thereby tearing said material at the weakest point thereof, that is, along a perforation line indicated at P in FIG. 2A. The pinching contact extends at least as far as the surface 1B which has the higher coefficient of friction. At this point, the leading edge of the web created by the tearing at P curls up (FIG. 2A) and begins to wind up on itself, forming the initial portion of the new log.

Figure 3:
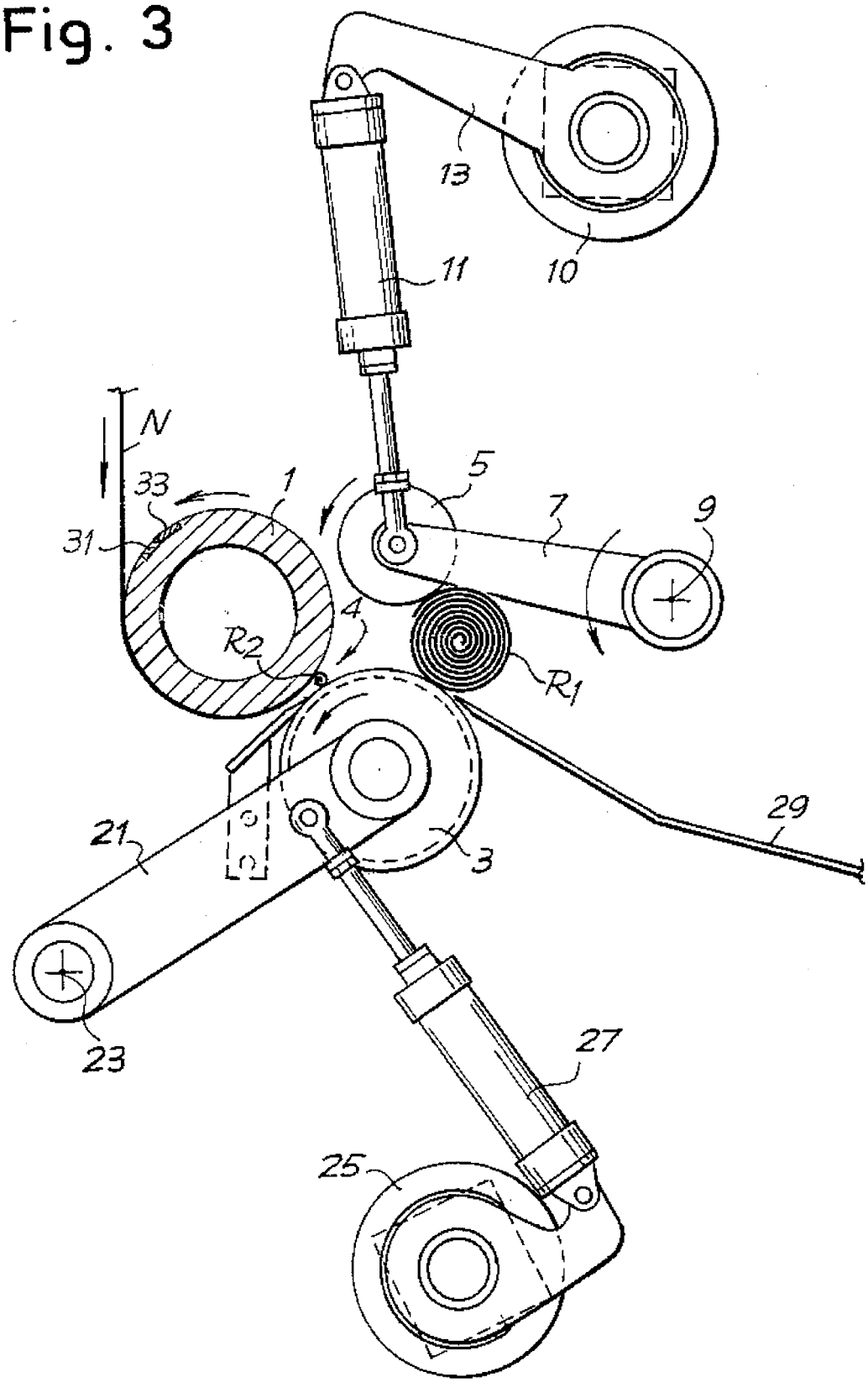
Figure 4:
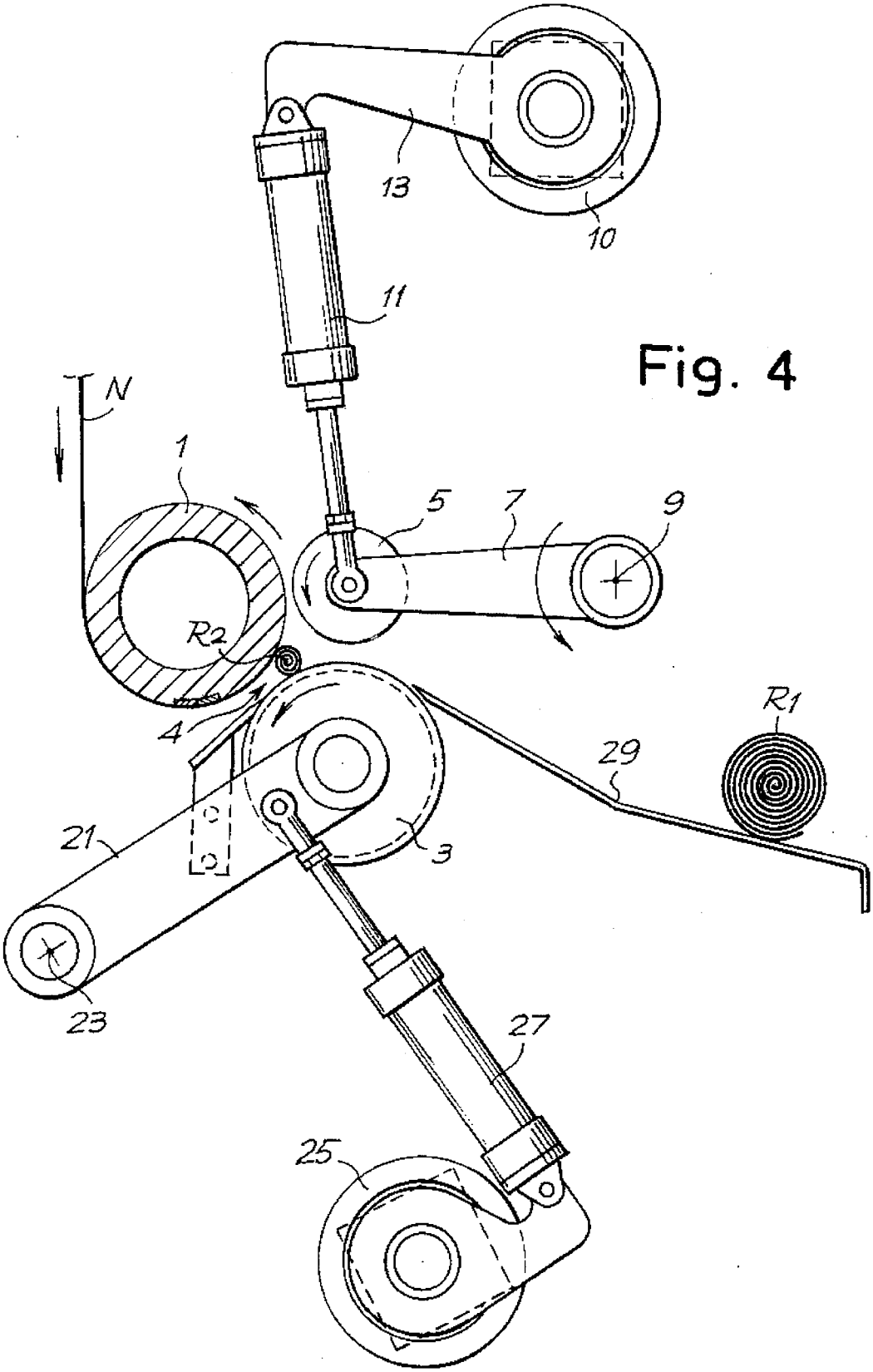

The new log, shown at R2 in FIGS. 3 and 4, begins to increase in diameter and move downstream through the nip 4 owing to the (constant or varying) difference of peripheral speed of rollers 1 and 3. At the same time, the log R1 is unloaded onto the chute 29 by the decelerating action of roller 3 (in case it is slowed down) and/or acceleration of roller 5. In order to accommodate the increasing diameter of the log R2, provision is made for the rollers 1 and 3 to move away from each other.

Figure 5:
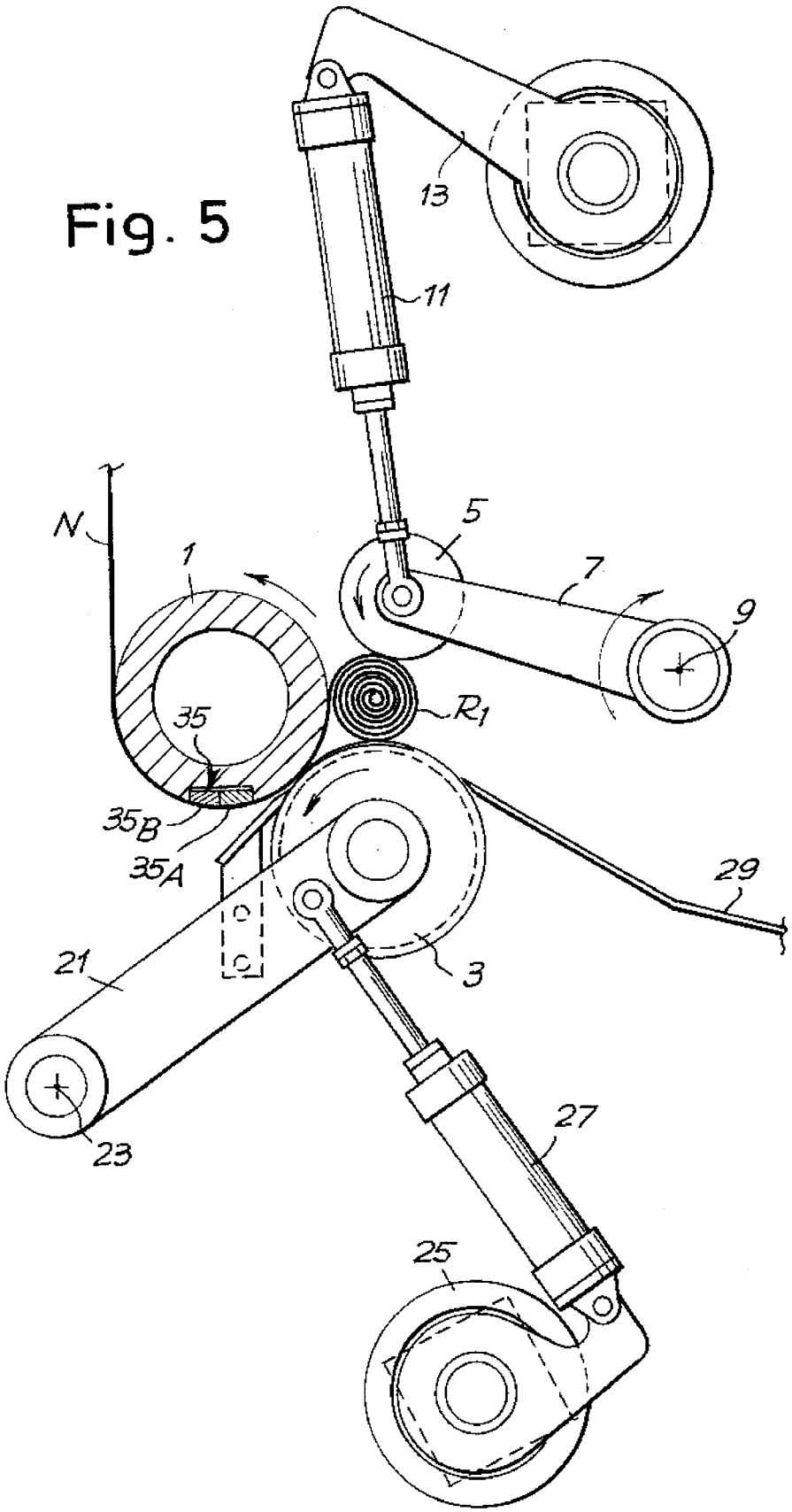
FIG. 5 shows a modified embodiment of the rewinder of FIGS. 1 to 4.

FIG. 5 shows a slightly modified embodiment of the rewinder according to the invention. Like numerals indicate corresponding parts of the embodiment of FIGS. 1 to 4. The winding roller 1 has a sector 35 extending lengthwise approximately the whole axial length of the roller. The sector 35 rests within a slot in roller 1 and is radially movable under precise control to be extended or retracted. The extending or withdrawal movement of the sector 35 may be accomplished by a mechanism similar to that described in Italian Patent No. 1,213,822 with reference to a removable blade. The subject matter of this patent is incorporated by reference in the present description.

The sector 35 is provided with two surface portions 35A and 35B having low and high coefficient of friction, respectively, and corresponding to the surfaces 1A and 1B of the embodiment of FIGS. 1 to 4.

The operation of the rewinder of FIG. 5 is similar to what has been described for the embodiment of FIGS. 1 to 3, the only difference being that the approach movement of rollers 1 and 3 is obtained from the combination of the oscillation movement of roller 3, operated by the actuator 25, and the extending of the movable sector 35. The two motions are suitably synchronized. The approach movement of roller 3 may be relatively slow, so as to avoid inertia-related problems due to the appreciable mass thereof.

Alternatively, the movable sector 35 may be provided on roller 3 instead of on roller 1.

Figure 6:
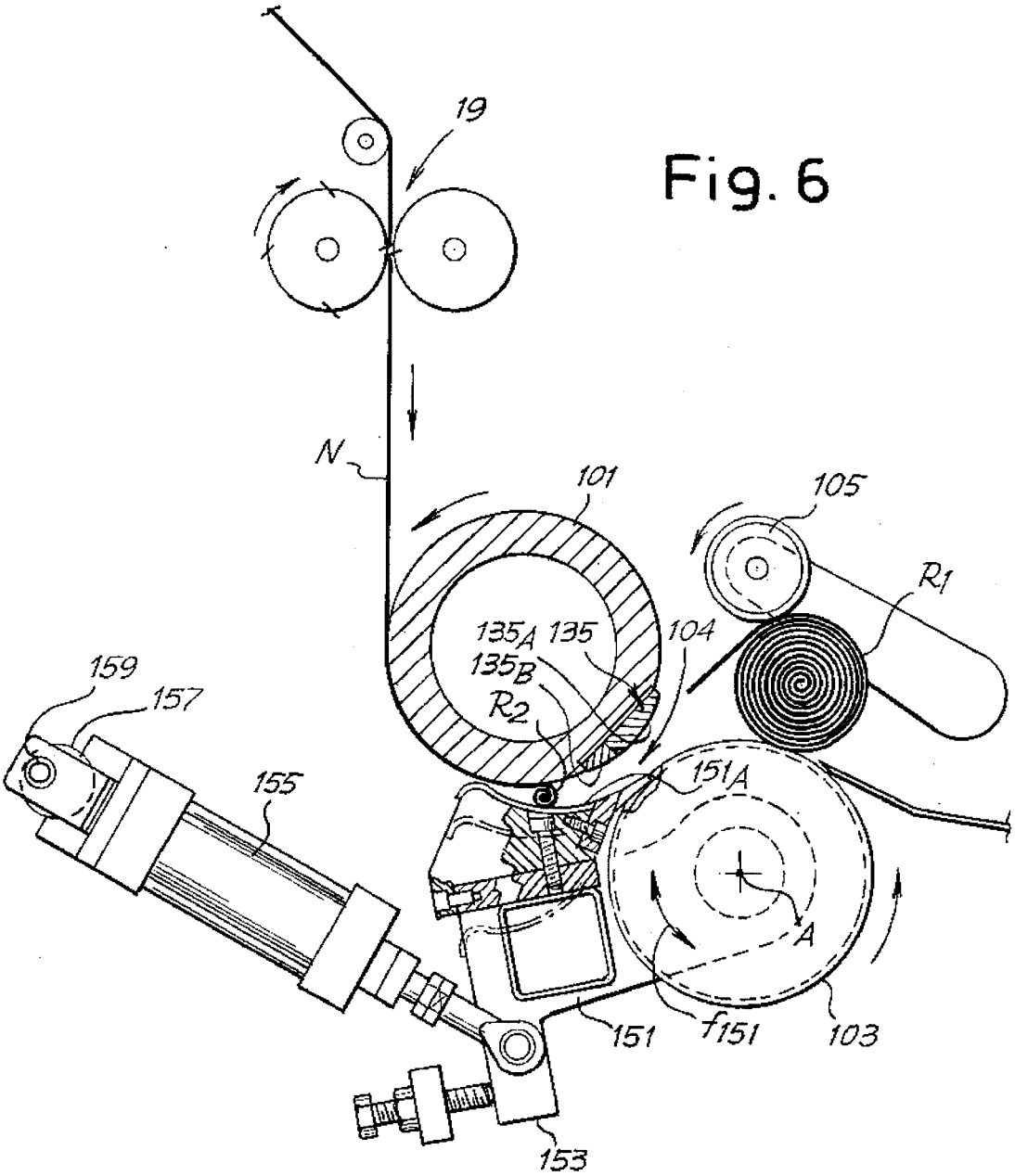
FIGS. 6 and 7 show two modified embodiments of the rewinder according to the invention.

FIG. 6 shows another modified embodiment of the rewinder according to the invention. In this embodiment, provision is made for a first winding roller 101, a second winding roller 103 and a third diameter-control roller 105, the latter being movable to follow the increase of the log R1 in the process of formation. Numeral 104 indicates the nip defined between the rollers 101 and 103.

Also pivotally supported at the axis of rotation A of the second roller 103 is a movable member 151, to an arm of which a resilient element 155 is articulated, which transmits an oscillation movement to the movable member 151 in the direction of the double arrow f151. The movement may be obtained in any suitable way, for example, with a cam 157 having an eccentric pivot 159 which forms, together with the resilient element 155, a crank-connecting-rod system.

The movable member 151 has a curved surface 151A defining, along with the surface of the first winding roller 101, a channel having a cross-section which increases in a downstream direction and wherein the log R2 begins to wind up on itself. The surface 151A of the movable member 151 cooperates with a sector 135, similar to sector 35 described with reference to the embodiment of FIGS. 1 to 4. The sector 135 has two external surface portions, indicated by 135A and 135B and having, respectively, a low and high coefficient of friction, said sector 135 being partially extended from its seat to bring it in contact with the movable member 151 after the latter has been brought to the position of maximum proximity to the winding roller 103. The pinching of the web between the surface 151A of the movable member 151 and the roller 103 takes place initially on surface 135A of sector 135.

The web material is torn and the new log begins to wind up on itself according to the procedures disclosed with reference to the previously described embodiment, but in this case rolling firstly onto the surface 151A before reaching the nip 164. Also in this case provision is made so that at the moment of pinching, a perforation line is located at the smooth surface 135A or slightly downstream thereof.

Figure 7:
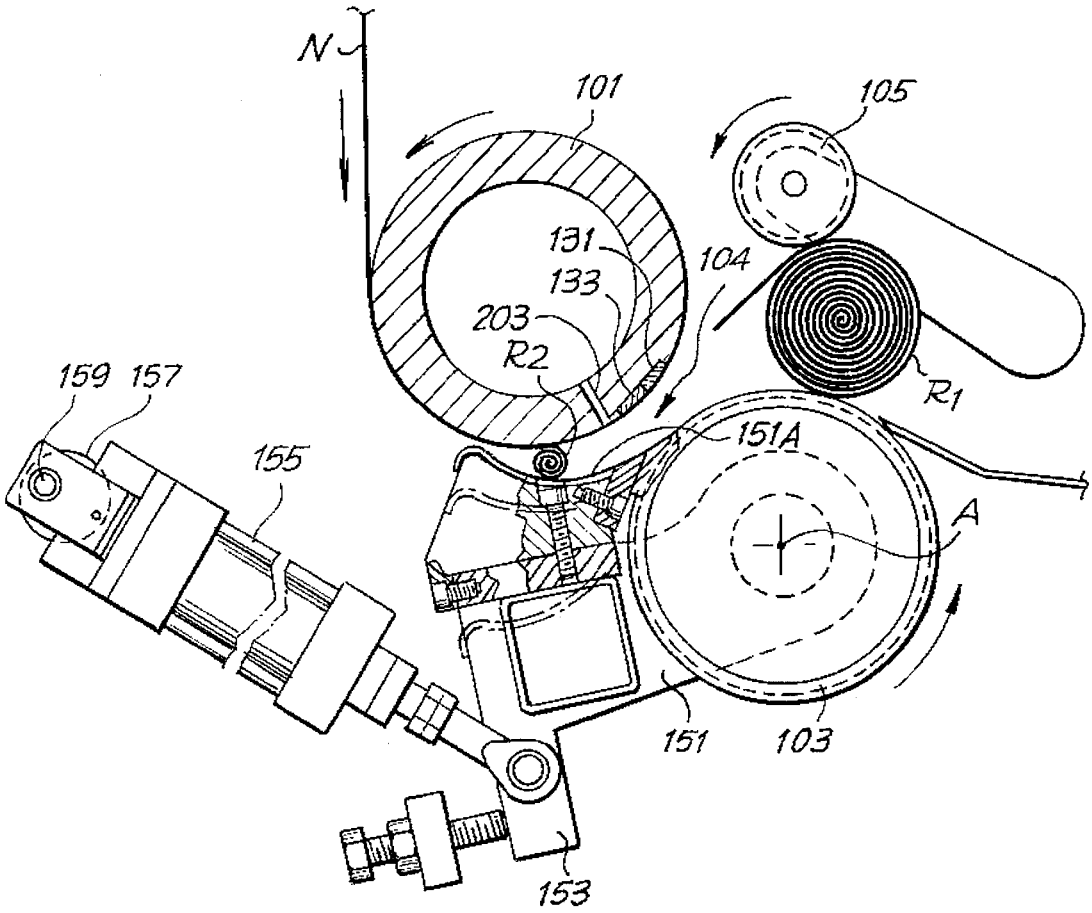
Figure 8:
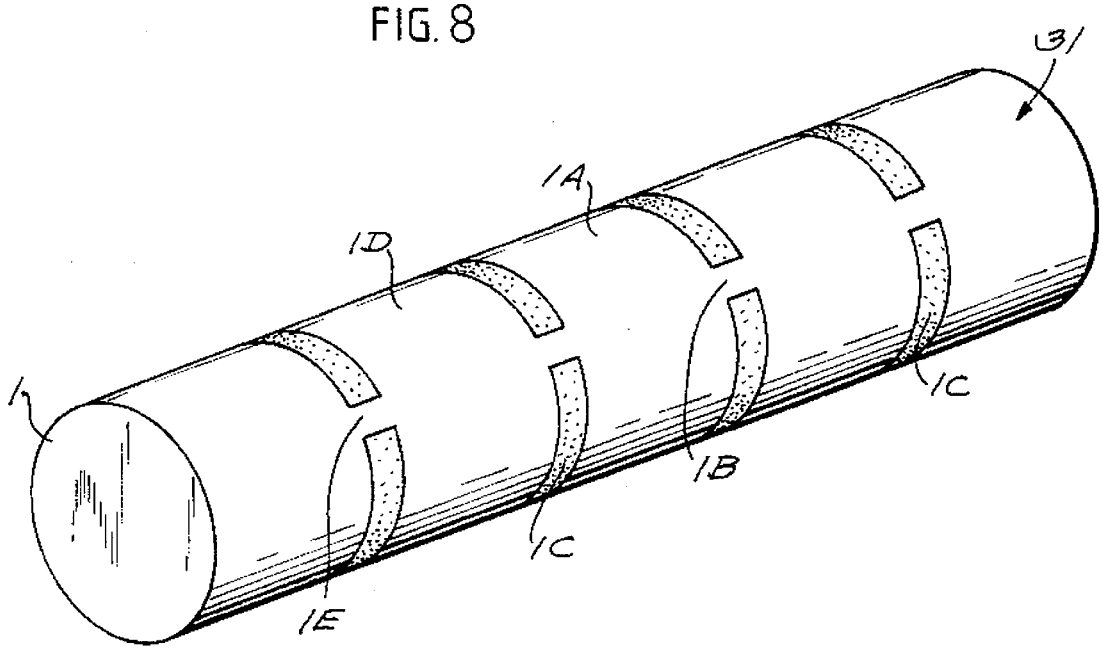
FIG. 8 is a perspective view of the first winding roller illustrating the surface portion having a low coefficient of friction and the adjoining surface having a coefficient of friction higher than that of the surface portion.

FIG. 7 shows an embodiment similar to the embodiment of FIG. 6. Like numerals indicate corresponding parts. In this embodiment, the movable sector 135 is replaced by two inserts 131 and 133, similar to inserts 31 and 33, arranged in a fixed position within a recess of the roller 103. The insert 131 has a smooth surface or a relatively low coefficient of friction, whereas the insert 133 has a rough surface or relatively high coefficient of friction. In this case, the approaching movement between the surface 151A of the movable member 151 and the roller 103 is performed entirely by the relative motion of the movable member 151 with respect to roller 103. Tearing of the web material and starting of the winding occur substantially as above described.

In the embodiments of FIGS. 6 and 7, it is optional to coat all or part of surface 151A with a resiliently yielding material.

When the surfaces of the winding rollers, or of the winding roller and the movable member, come in contact with each other to cause tearing of the web material and starting of the winding, the web material in some cases may become loose upstream of the contact region. Suitable means can therefore be provided to prevent this slackening of tension from spreading into the upstream web material. A means suited for this purpose may consist of a small roller, of either motor-driven or idle type, placed in contact with the web material where said material is fed onto the roller (1 or 101). A roller of this type is shown with dashed lines in FIG. 1 and designated 201. The contact between the rollers 1 and 201 prevents said slackening of the web material N and decreased tension from propagating upstream of said rollers.

Further means may also be provided to avoid said slackening, such as a plurality of suction holes 203 in the cylindrical wall of roller 1 or 101, which cause the web material to adhere to the surface of the roller 1 or 101. A solution of this type is shown in FIG. 7. It will be appreciated that the two solutions are interchangeable or combinable in all the embodiments illustrated in the attached figures. When using the suction system, the vacuum in the holes 203 may be applied or interrupted by suitable suction boxes within the roller 1 or 101, all as well-known in the art.

It is understood that the drawing shows an exemplification given only as a practical demonstration of the invention, as this may vary in forms and dispositions, nevertheless, being within the scope of the idea on which the same invention is based. In particular, the surface portion of the first winding roller having high coefficient of friction may actually consist of annular strips 1C being coated, for example, with emery cloth. Each annular strip may be separated from the adjoining strips by annular portions 1D of smooth surface. Each annular strip having high coefficient of friction will be, in this case, interrupted by a section 1E having low coefficient of friction. The various sections with low coefficient of friction will be lined up to each other in the axial direction of the roller, to make an almost continuous, longitudinal, smooth surface.

Having thus described the invention, what is claimed as new and desired to protect by Letters Patent are the following:

1. A surface rewinding machine for the formation of logs of web material comprising at least a winding roller onto which the web material is fed, wherein:

said winding roller has a surface, a length and an axis, and a surface portion extending substantially parallel to the roller axis and an adjoining surface, said surface portion having a coefficient of friction lower than that of the adjoining surface located upstream with respect to the material-feeding direction, means are provided which, upon completion of a log, pinch the web material against said surface portion, thereby causing said web to slide on said surface portion and the web to tear between the pinching point and the finished log.

2. A rewinding machine according to claim 1 wherein said surface portion having lower coefficient of friction extends substantially the length of the winding roller.

3. A rewinding machine according to claim 1, wherein the surface of said winding roller has annular regions having a substantially constant coefficient of friction, each annular region having a section of the surface thereof which has a lower coefficient of friction, the sections having lower coefficient of friction of each annular region being longitudinally aligned to make up said surface portion with lower coefficient of friction.

4. A rewinding machine according to claim 1 wherein said winding roller is provided with a second surface portion developing parallel and adjacent to said surface portion having lower coefficient of friction and being located upstream thereof with respect to the web material-feeding direction, the coefficient of friction of said second portion being higher than the coefficient of friction of all the remaining surface of the winding roller.

5. A rewinding machine according to claim 1 including a second winding roller rotating in the same direction as the first winding roller and forming, along with the first winding roller, a nip through which the web material is made to transit, said first and second winding rollers being movable away from and toward each other to pinch said web between the surfaces of the rollers at the surface portion having low coefficient of friction.

6. A rewinding machine according to claim 1 including a second winding roller rotating in the same direction as the first winding roller and forming, along with the first winding roller, a nip through which the web material is made to transit, and a movable member arranged upstream of said nip with respect to the web feeding direction, said movable member being intermittently movable closely toward the first winding roller where said surface portion, having lower coefficient of friction is located, said movable member pinching the web material against said surface portion.

7. A rewinding machine according to claim 1 wherein it includes means to avoid the slackening of the web material being fed during tearing of the web material and starting of the winding thereof to form a new log.

8. A rewinding machine according to claim 1 characterized in that it comprises perforating means to carry out lines of transverse perforations on said web material, and synchronization means to synchronize with the perforating means the motion of said means which press the web material against the winding roller.

9. A method of producing logs of web material, including the steps of:

providing a first winding roller having an axis;

feeding said web material around said first winding roller and forming a log with said web;

upon completion of a log, severing the web material when the log is completed with a pre-determined quantity of web material wound thereon;

and, after severance of the web material, winding the incoming web to form a new log;

providing on said winding roller a surface portion and an adjoining surface, said surface portion having a coefficient of friction lower than that of the adjoining surface located upstream with respect to the web feeding direction, said surface portion extending approximately parallel to the axis of the roller;

upon completion of a log, pinching the web material against said winding roller at said surface portion having a lower coefficient of friction, whereby causing the web material to slide along said surface portion and to tear the web between the pinch point and the finished log.

10. A method according to claim 9, wherein after tearing of the web the free leading edge of said web is wound on itself to start winding of a log with no central winding core.

11. A method according to claim 9 including the steps of:

causing the web material to slide by keeping it pressed onto said surface portion having lower coefficient of friction until it comes into contact with a surface portion on said winding roller having higher coefficient of friction, thus causing the free edge of the web material to wind up on itself to form a log without central core.

12. A method according to claim 9 including the steps of:

providing a second winding roller rotating in the same direction as the first winding roller and forming, along with the first winding roller, a nip through which the web material is made to pass, and bringing the surfaces of said first and second winding rollers toward each other in such a Way as to pinch the web material between them and against said surface portion having lower coefficient of friction.

13. A method according to claim 9 including the steps of:

providing a second winding roller rotating in the same direction as the first winding roller and forming, along with the first winding roller, a nip through which the web material is made to pass;

providing a movable member cooperating with the first winding roller, said movable member being arranged upstream of said nip with respect to the web feeding direction;

and bringing said movable member cyclically in contact with said first winding roller to pinch the web material on said surface portion having lower coefficient of friction on said first winding roller.

14. A method according to claim 9 characterized by forming transverse perforation lines on said web material and synchronizing the pressure action on the web material against the winding roller to cause the web material to tear and positioning the perforation lines so that at the moment the web material is pressed against the surface of the winding roller, a line of perforations will be located immediately downstream of the region in which the web material is pressed.

* * * * *